US008087819B2

(12) United States Patent
Chiuve et al.

(10) Patent No.: US 8,087,819 B2
(45) Date of Patent: Jan. 3, 2012

(54) DIRECT-IMPULSE ESCAPEMENT, ESPECIALLY OF DETENT TYPE, FOR A HOROLOGICAL MOVEMENT

(75) Inventors: Alexandre Chiuve, Grand-Lancy (CH); Fabiano Colpo, Lausanne (CH)

(73) Assignee: Rolex S.A., Geneva (CH)

( * ) Notice: Subject to any disclaimer, the term of this patent is extended or adjusted under 35 U.S.C. 154(b) by 176 days.

(21) Appl. No.: 12/712,776

(22) Filed: Feb. 25, 2010

(65) Prior Publication Data

US 2010/0214881 A1 Aug. 26, 2010

(30) Foreign Application Priority Data

Feb. 26, 2009 (EP) ..... 09405037

(51) Int. Cl.
*G04B 15/00* (2006.01)

(52) U.S. Cl. ..... 368/127; 368/129

(58) Field of Classification Search ..... 368/124, 368/125, 127–131
See application file for complete search history.

(56) References Cited

U.S. PATENT DOCUMENTS

| | | | | |
|---|---|---|---|---|
| 40,508 | A | 11/1863 | Stephenson | |
| 51,191 | A | 11/1865 | Karr | |
| 1,091,261 | A | 3/1914 | Walker | |
| 3,538,705 | A * | 11/1970 | Perry | 368/125 |
| 4,122,665 | A * | 10/1978 | Giger | 368/327 |
| 7,097,350 | B1 * | 8/2006 | Conus et al. | 368/127 |

OTHER PUBLICATIONS

European Search Report mailing date of Aug. 12, 2009, issued in corresponding European Patent Application EP 09 40 5037.

* cited by examiner

*Primary Examiner* — Vit Miska
(74) *Attorney, Agent, or Firm* — Westerman, Hattori, Daniels & Adrian, LLP

(57) ABSTRACT

This escapement comprises a balance wheel (3), an escape wheel (1), a detent rocker (4) having an arresting element (4*a*) and an elastic clearance element (4*c*), means for inserting the arresting element into the path of the teeth of the escape wheel (1), and a clearance pin (7) rotating integrally with the balance wheel (3) in order to engage with the elastic clearance element (4*c*) of the rocker (4) once per period of oscillation of the balance wheel. The means for inserting the arresting element (4*a*) into the path of the teeth of the escape wheel (1) comprise a sliding surface (4*b*) integral with the detent rocker (4) and arranged so as to move into the path of the teeth of the escape wheel (1) when the arresting element (4*a*) leaves it, this sliding surface being shaped so as to return the arresting element (4*a*) to the locking position.

6 Claims, 4 Drawing Sheets

DIRECT-IMPULSE ESCAPEMENT, ESPECIALLY OF DETENT TYPE, FOR A HOROLOGICAL MOVEMENT

The present invention relates to a direct-impulse escapement, especially of detent type, for a horological movement, comprising a balance wheel attached to an impulse element, an escape wheel whose teeth intersect the path of the impulse element, a detent rocker having an arresting element and a clearance element, means for inserting the arresting element into the path of the teeth of the escape wheel, a clearance pin rotating integrally with the balance wheel, and means for engaging said clearance pin with the clearance element of the rocker once per period of oscillation of the rocker to clear the arresting element from the escape wheel tooth; in which said means for inserting the arresting element into the path of the teeth of the escape wheel comprise a sliding surface integral with the detent rocker and arranged so as to move into the path of the teeth of the escape wheel when the arresting element leaves it, this sliding surface being shaped so that the force applied to it by a tooth of the escape wheel causes the arresting element of the detent rocker to move back into the path of the teeth of the escape wheel.

One escapement that is particularly highly regarded for its general performance (efficiency and isochronism) is the so-called detent escapement which releases the gear train when the balance wheel rotates in one direction, while this same system allows the balance wheel to pass without any other action than the bending of the elastic clearance element during its return. This advantageous function can be obtained by using a flexible element (generally a strip) which is immobilized in one direction in order to allow the release of the escape wheel following the bending of a second flexible element. When the balance wheel is rotating in the reverse direction, the first strip is able to bend freely without releasing the escape wheel, thus avoiding a needless loss of energy.

The second flexible element is necessary to return the blocking lever to its initial position. However, at the moment of release of the escape wheel, the system has to overcome the draw of the escape wheel and the second flexible element, which results in a considerable loss of energy because the energy supplied to the second flexible element to deform it (some 50% of the total amount of energy that must be supplied to release the wheel) is lost.

The sizing of the detent (the flexible parts in particular) is clearly one of the critical points in developing the detent escapement. Sufficient stiffness is required to keep the escape wheel locked, but at the same time not too much energy must be required to release the escape wheel during the impulse that is supplied to the balance wheel, the risk being a not insignificant perturbation of the balance wheel/hairspring system and a large reduction in the associated efficiency. The unlocking torque required to release the escape wheel also represents a safeguard against knocks which defines a lower limit to the stiffness of the second flexible element.

A detent escapement of the type discussed above is described in U.S. Pat. No. 40,508.

This mechanism was much used in marine chronometry; it is expensive and sensitive, requires perfect execution, and is not easily converted to mass production. On the other hand, it is an excellent escapement, allowing very precise adjustment and consequently giving the best chronometric service.

However, in such an escapement, the draw of the escape wheel is the only safeguard. This is insufficient in the case of a wristwatch which is likely to suffer knocks which would seriously interfere with its correct running.

The object of the present invention is to at least partly solve the abovementioned disadvantages.

To this end, the present invention relates to a direct-impulse escapement, especially of detent type, for a horological movement according to Claim 1.

The main advantage of such an escapement is that it increases the safety with respect to knocks. Moreover, the detent rocker with an arresting element and a sliding surface which move alternately into the path of the escape wheel teeth constitutes an additional safeguard.

The arresting element of the detent rocker comprises a safety surface situated outside of the path of the escape wheel teeth and adjacent to this path when the detent rocker is in the unlocking position. Advantageously, the length of this safety surface corresponds to the angle travelled by the escape wheel to communicate the movement impulse to the balance wheel, in order to prevent the premature return of the arresting element into the path of the teeth of the escape wheel. It is therefore a second safeguard.

The accompanying drawings illustrate, diagrammatically and by way of example, an embodiment and a variant of a detent escapement forming the subject matter of the invention.

Figure 1:
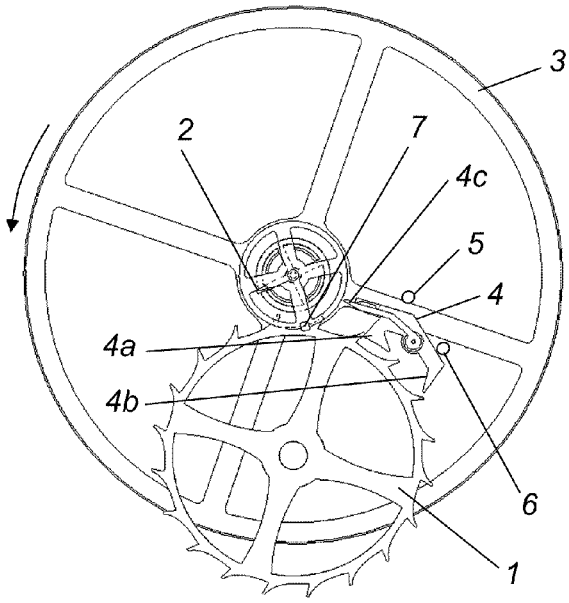
FIG. 1 is a plan view of the detent escapement to which the invention relates, with an associated balance wheel/hairspring oscillator.

The escapement illustrated in FIG. 1 comprises an escape wheel 1, the circular path of whose teeth intersect the path of an impulse pallet 2 integral with the balance wheel 3 connected to a hairspring (not shown).

A detent rocker 4 is able to move freely between two stops 5, 6. It comprises on the one hand an arresting element with a stop face 4*a* for arresting a tooth of the escape wheel 1, and on the other hand, a sliding surface 4*b* to allow an escape wheel tooth to slide over this surface 4*b* and pivot the rocker in the anticlockwise direction so as to move the stop face back into the path of the teeth of the escape wheel 1. This detent rocker 4 also has an elastic clearance element 4*c* which is pressed against a stop 4*d* and whose free end moves into the path of a clearance pin 7 integral with the balance wheel 3.

The arresting element of the detent rocker 4 also has a safety surface 4*e* which is located outside of the path of the teeth of the escape wheel 1 and adjacent to this path when the detent rocker 4 presses against the stop (FIGS. 3 to 6). This surface occupies an angle of the escape wheel 1 corresponding to the angle during which an escape wheel tooth communicates its impulse to the impulse pallet 2 of the balance wheel 3.

A cycle of oscillation of the balance wheel/hairspring can be broken down into the different phases illustrated in FIGS. 1 to 11.

In the phase illustrated in FIG. 1, the balance wheel is turning anticlockwise. The stop face 4*a* of the arresting element of the rocker 4 locks the escape wheel 1, which in turn holds the rocker 4 against the stop 6.

Figure 2:
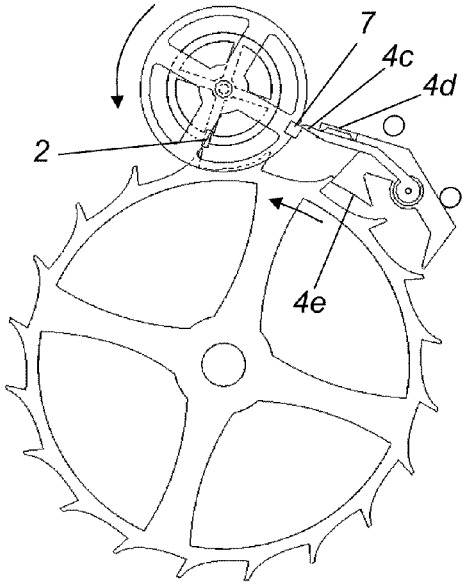
FIGS. 2 to 11 illustrate the escapement of FIG. 1 on a larger scale, without the balance wheel, in different positions during one cycle of oscillation.
Figure 3:
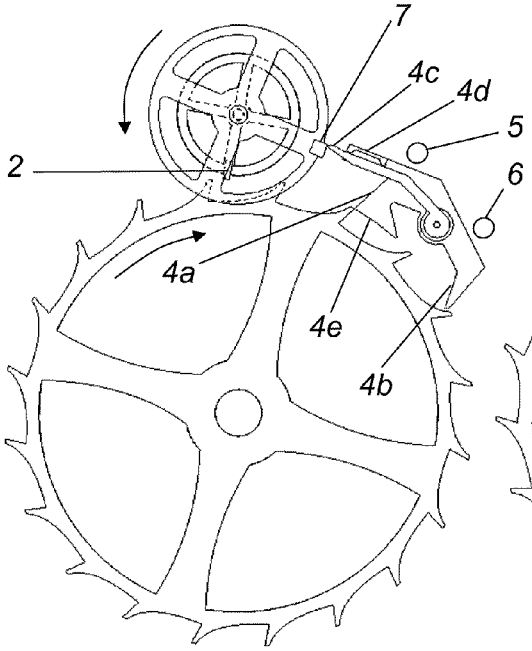

The phase illustrated in FIG. 2 corresponds to the moment at which the clearance pin 7 integral with the balance wheel 3 meets the elastic clearance element 4*c* pressed against the stop 4*d*. Because of the stop 4*d* and because of the anticlockwise rotation of the balance wheel 3, the elastic clearance element 4*c* behaves like a rigid element.

The detent rocker 4 then moves, under the action of the clearance pin 7, from pressing against the stop 6 to pressing against the stop 5 (FIG. 3), thus freeing the escape wheel 1, one tooth of which had been arrested by the stop face 4*a* of the arresting element of the detent rocker 4.

Figure 4:
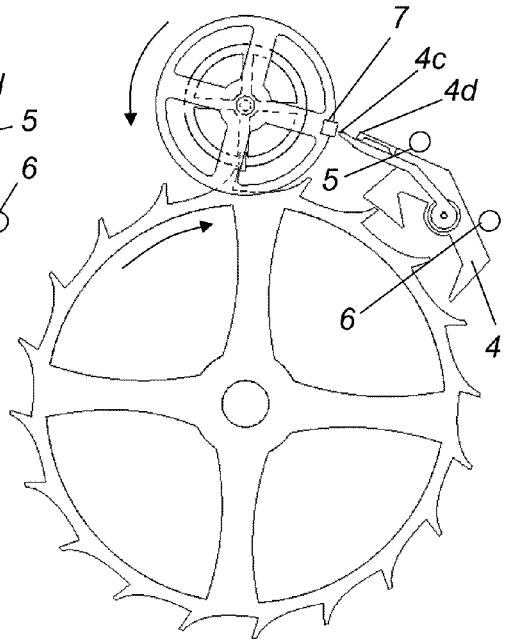

Since the escape wheel 1 is subjected to the torque of the mainspring (not shown) transmitted by the going train (not shown), it is now driven clockwise. One of its teeth then meets the impulse pallet 2 of the balance wheel 3 (FIG. 4). This is the start of the impulse phase, in which the energy of the mainspring is transmitted to the balance wheel 3 in order to give it the energy necessary to keep it oscillating.

Figure 5:
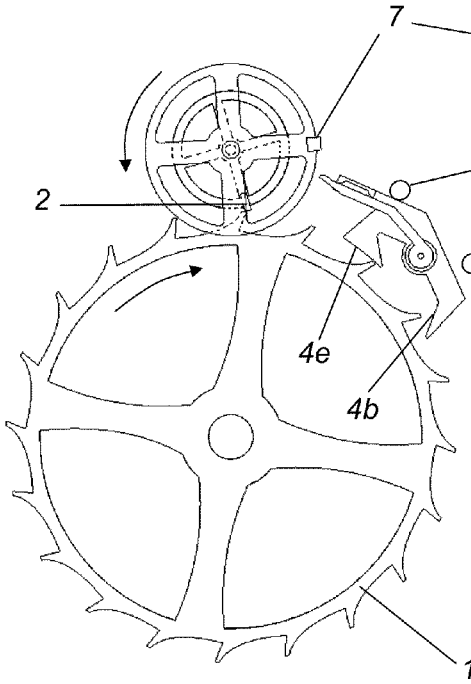

This impulse phase ends when the escape wheel tooth leaves the impulse pallet—that is, practically in the position illustrated in FIG. 5. As can be seen, throughout this impulse phase, the safety surface 4*e* of the arresting element of the detent rocker 4 prevents the arresting element from moving into the path of the teeth of the escape wheel 1 as the result of a knock, for example.

Figure 6:
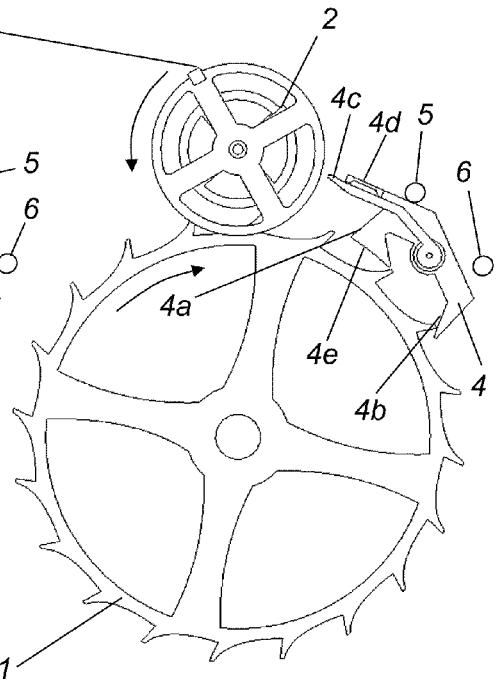
Figure 7:
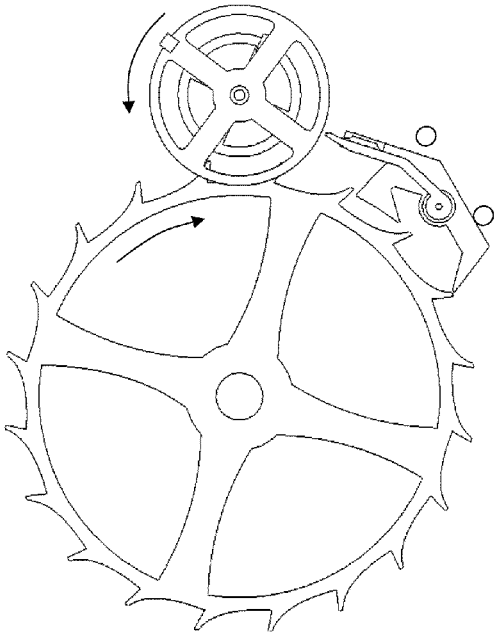
Figure 8:
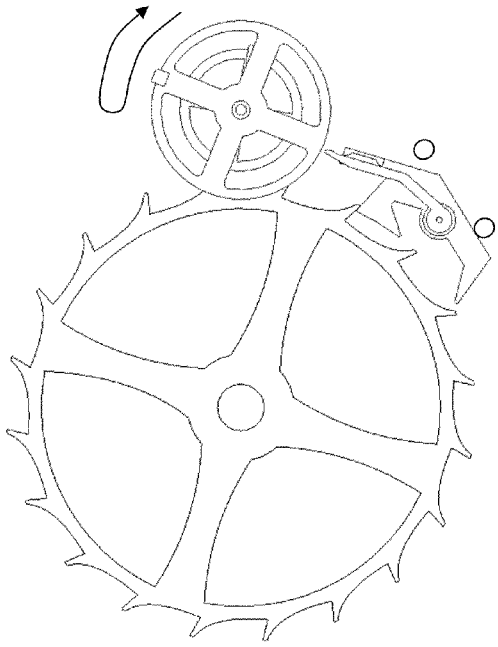
Figure 9:
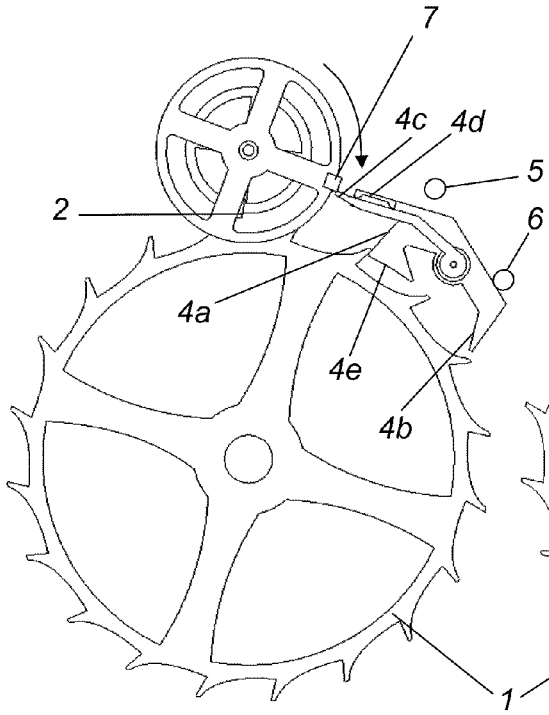
Figure 10:
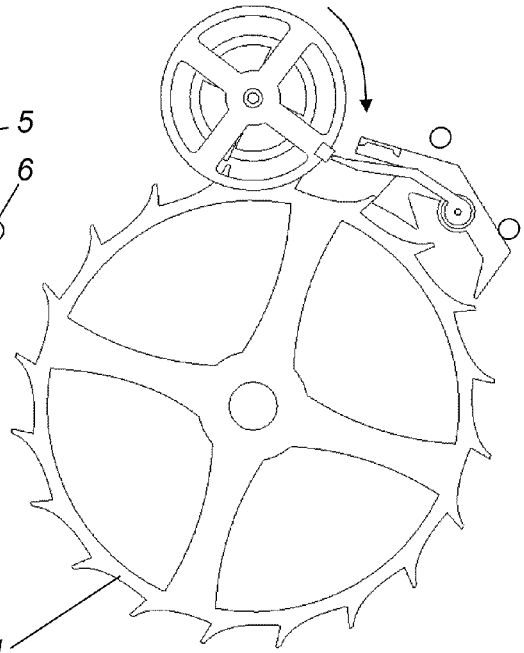
Figure 11:
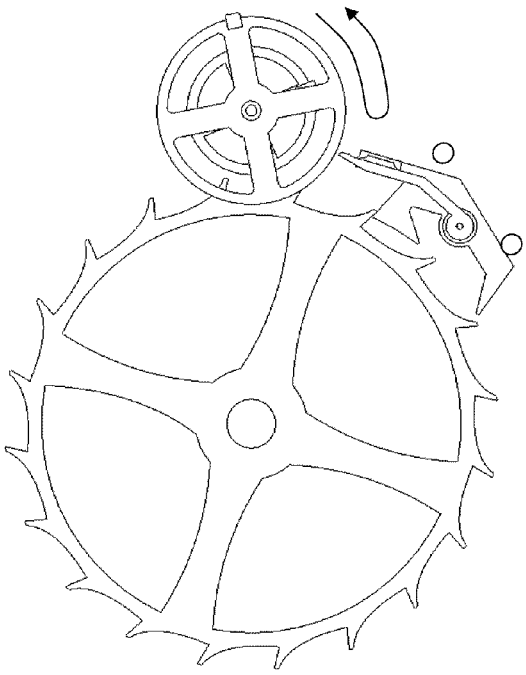

After the impulse phase, the escape wheel 1 continues its rotation and one of its teeth meets the sliding surface 4*b* (FIG. 6). As it slides against this surface 4*b*, the escape wheel tooth turns the rocker 4 anticlockwise and moves it back against the stop 6 (FIG. 7). This pivoting movement also moves the arresting element of the rocker 4 back into the path of the teeth of the escape wheel 1, so that one tooth of the escape wheel strikes the stop face 4*a* of the arresting element and exerts on the rocker 4 a torque which holds it against the stop 6 (FIG. 8).

Meanwhile, the balance wheel 3 has continued turning in the anticlockwise direction until the hairspring brings it to a halt and makes it rotate in the clockwise direction.

When the clearance pin 7 meets the elastic clearance element 4*c* of the detent rocker 4 (FIG. 9), it moves it off the stop 4*d* (FIG. 10) without displacing the detent rocker 4. The impulse pallet 2 of the balance wheel 3 passes between two adjacent teeth of the escape wheel 1 without touching them.

The balance wheel 3 goes on turning until it is brought to a halt by the hairspring and turned back anticlockwise (FIG. 11), thus commencing a new cycle of oscillation.

Figure 12:
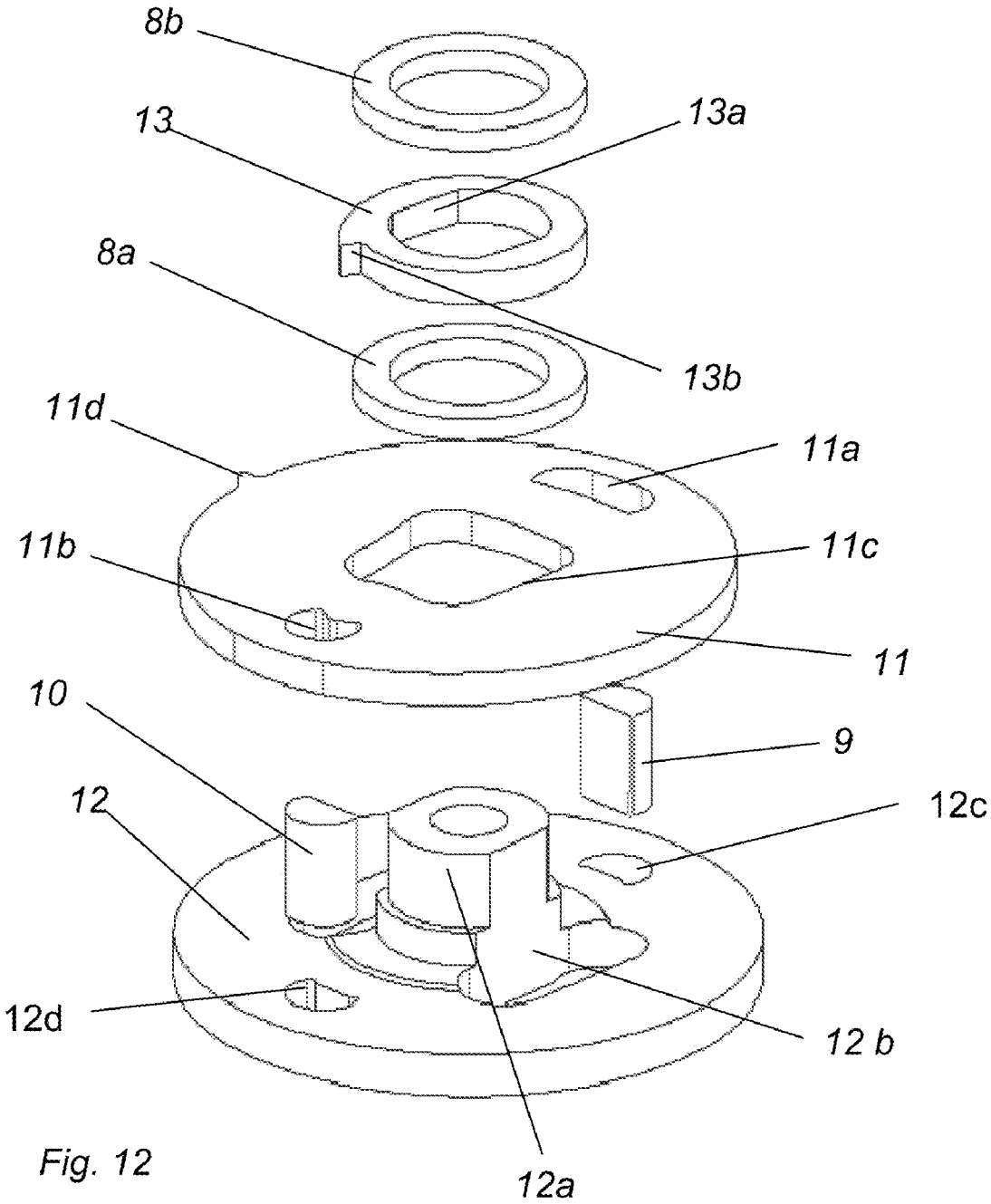
FIG. 12 is an exploded perspective view of a variant of the embodiment seen in the preceding figures.

FIG. 12 shows a variant of the impulse and clearance device connected to the balance wheel staff in place of the impulse pallet and in place of the clearance pin of the previous embodiment. This variant has a circular roller 12 provided with a tubular element 12*a* designed to be driven onto the balance wheel staff. This tubular element 12*a* has a partially circular outer section intersected by two parallel external flat faces 12*b* on which is engaged an impulse ring 13 containing an opening 13*a* whose cross section fits the external cross section of the tubular element 12*a*. The impulse ring 13 is held axially between two driven retaining rings 8*a*, 8*b*. The impulse ring 13 has an impulse pin or face 13*b* projecting from the external lateral face of the impulse ring 13. The pin of the impulse ring may be an attached component such as a pallet.

Two impulse pins 9 and 10, of semicircular cross sections in this example, are driven into two diametrically opposite openings 12*c*, 12*d*, respectively, of corresponding cross sections formed in the roller 12.

An inertial member 11 is provided with three openings 11*a*, 11*b*, 11*c*, two 11*a*, 11*b* of which are eccentric and preferably symmetrical and diametrically opposed. One of these openings 11*b* is semicircular and limited by two radii forming an angle of more than 180° to take a pivot impulse pin 10 of the inertial member 11 while allowing it room for angular movement. The other opening is elongate 11*a* to accommodate the impulse pin 9. The third opening is a central opening 11*c* for the loose passage of the tubular part 12*a* of the roller 12 and can be used, in the absence of the opening 11*a* and of the impulse pin 9, to limit the angular movement of the inertial member 11. A clearance pin 11*d* projects from the external lateral face of the inertial member 11. This clearance pin 11*d* is triangular in the example considered, with a driving face oriented radially with respect to the centre of the inertial member 11 and the other face sloping. The clearance pin 11*d* could also be formed by affixing a pallet such as a ruby pallet. The sloping face of the clearance pin 11*d* serves to push the inertial element 12 back if a knock has moved it into a projecting position when it should be out of the way.

The inertial member 11 is located at the base of the tubular part 12*a*. As seen in FIG. 12, the openings 11*a*, 11*b*, 11*c* are located, sized and shaped in such a way as to allow the inertial member 11 to perform a limited angular movement about the axis of the impulse pin 10, which is parallel to the axis of the roller 12 driven onto the balance staff, and which forms the pivot member of the inertial member 11. The elongate opening 11*a* lies symmetrically about a diameter of the inertial element 11 passing through the respective axes of the openings 11*b*, 11*c*, so that the two limit positions of the inertial member 11 are respectively situated symmetrically on either side of the balance staff.

In one angular position of the inertial member 11, the clearance pin 11*d* projects from the outer edge of the circular roller 12. As it turns clockwise, the radial face of the triangular pin meets the clearance element 4*c*, which no longer needs to be elastic, so that the clearance pin 11*d* lifts the detent rocker 4.

The inertial member 11 has two stable positions, each depending on the direction of rotation of the balance wheel. Tests have shown that the inertial member 11 moves before the balance wheel has completed each of the two alternations making up its oscillation period, but its rotation about the impulse pin 10 starts in the vicinity of dead centre of the balance wheel (angle 0 of its position).

At dead centre, the balance wheel is moving at maximum speed and therefore changes from a positive acceleration to a negative acceleration (it begins to decelerate), and it is at this moment that the inertial effects begin to be felt.

When the inertial member 11 is moved clockwise about the axis of the impulse pin 10, the clearance pin 11*d* is retracted inside the outer edge of the circular roller 12.

As a result, the clearance pin 11*d* does not engage with the detent rocker 4 as it passes in front of the clearance element 4*c*. Unlike all known escapements using direct impulse transmission, there is nothing for the clearance pin 11*d* to overcome in order to pass the obstacle of the element 4*c* of the clearance rocker 4 during the alternation of the balance wheel in which the latter receives no impulse tending to maintain its oscillating movement, because the pin is retracted within the circular edge of the roller 12. There is therefore no loss of energy or perturbation of the oscillation period of the balance wheel.

When the balance wheel 3 arrives at the end of its anticlockwise rotation (FIG. 7), its deceleration once again moves the inertial member 12, which returns to the position in which the clearance pin 11*d* projects out of the circular edge of the roller 12.

The angular movement of the inertial member 11 between its two limit positions is only a few degrees, typically around 5° to 10°, these two limit positions being situated symmetrically on either side of the balance wheel staff. This inertial member 11 may be made of a low-density material because the inertial effect is always sufficient for it to function. The freedom of choice as to the external geometrical shape means that the inertial element can be made symmetrical, ensuring that the added unbalanced weight is low. Experimentation shows that with a low-density material such as silicon, the influence on the balance of the balance wheel is negligible.

The invention claimed is:

1. Direct-impulse escapement, especially of detent type, for a horological movement, comprising:

a balance wheel attached to an impulse element, an escape wheel whose teeth intersect the path of the impulse element, a detent rocker having an arresting element and a clearance element, means for inserting the arresting element into the path of the teeth of the escape wheel, a clearance pin rotating integrally with the balance wheel, and means for engaging said clearance pin (7,11*d*) with the clearance element of the rocker once per period of oscillation of the rocker to clear the arresting element from the escape wheel tooth;

said means for inserting the arresting element into the path of the teeth of the escape wheel comprising a sliding surface integral with the detent rocker and arranged so as to move into the path of the teeth of the escape wheel when the arresting element leaves it, this sliding surface being shaped so that the force applied to it by a tooth of the escape wheel causes the arresting element of the detent rocker to move back into the path of the teeth of the escape wheel;

the arresting element of the detent rocker comprising a safety surface situated outside of the path of the teeth of the escape wheel (1) and adjacent to this path when the detent rocker is in the unlocking position, in order to prevent the arresting element (4) from moving into the path of the teeth of the escape wheel while the latter is communicating a movement impulse to the balance wheel.

2. Escapement according to claim 1, in which the length of the safety surface corresponds to the angle travelled by the escape wheel to communicate the movement impulse to the balance wheel, in order to prevent the premature return of the arresting element into the path of the teeth of the escape wheel.

3. Escapement according to claim 1, in which said clearance element is pressed elastically against a stop, so that it behaves like a rigid element when said clearance pin meets it while rotating in one direction and moves away elastically when the disengagement pin meets it while rotating in the other direction.

4. Escapement according to claim 1, in which said clearance pin is integral with an inertial member mounted freely between two extreme positions, in one of which the path of the clearance pin passes by said clearance element of the rocker, and in the other of which this path does not pass by this clearance element, the passage of the inertial member from one position to the other resulting from the inertial force acting on the inertial member due to the variations of speed of the balance wheel during each half-cycle of oscillation of the balance wheel.

5. Escapement according to claim 2, in which said clearance element is pressed elastically against a stop, so that it behaves like a rigid element when said clearance pin meets it while rotating in one direction and moves away elastically when the disengagement pin meets it while rotating in the other direction.

6. Escapement according to claim 2, in which said clearance pin is integral with an inertial member mounted freely between two extreme positions, in one of which the path of the clearance pin passes by said clearance element of the rocker, and in the other of which this path does not pass by this clearance element, the passage of the inertial member from one position to the other resulting from the inertial force acting on the inertial member due to the variations of speed of the balance wheel during each half-cycle of oscillation of the balance wheel.

* * * * *

UNITED STATES PATENT AND TRADEMARK OFFICE

CERTIFICATE OF CORRECTION

PATENT NO. : 8,087,819 B2
APPLICATION NO. : 12/712776
DATED : January 3, 2012
INVENTOR(S) : Alexandre Chiuvé et al.

It is certified that error appears in the above-identified patent and that said Letters Patent is hereby corrected as shown below:

In column 5:

On line 16, in claim 1, after "clearance pin" delete "(7,11d)"

On line 31, in claim 1, after "escape wheel" delete "(1)"

On line 33, in claim 1, after "arresting element" delete "(4)"

Signed and Sealed this
Eighth Day of May, 2012

David J. Kappos

David J. Kappos
*Director of the United States Patent and Trademark Office*